United States Patent [19]

Kuhn et al.

[11] Patent Number: 4,570,166

[45] Date of Patent: Feb. 11, 1986

[54] RF-TRANSPARENT SHIELD STRUCTURES

[75] Inventors: Donald H. Kuhn, North Syracuse; Conrad E. Nelson, Camillus; Cousby Younger, Jr., Syracuse; Gerald A. Otteni, Minoa, all of N.Y.

[73] Assignee: General Electric Company, Syracuse, N.Y.

[21] Appl. No.: 527,280

[22] Filed: Aug. 29, 1983

[51] Int. Cl.[4] ..... H01Q 1/42

[52] U.S. Cl. ..... 343/872

[58] Field of Search ..... 343/753, 754, 755, 872, 343/909

[56] References Cited

U.S. PATENT DOCUMENTS

| | | | |
|---|---|---|---|
| 3,310,808 | 3/1967 | Friis | 343/872 |
| 3,334,349 | 8/1967 | Wheeler | 343/872 |
| 3,448,455 | 6/1969 | Alfandari et al. | 343/756 |
| 3,975,738 | 8/1976 | Pelton et al. | 343/872 |

*Primary Examiner*—Eli Lieberman

*Attorney, Agent, or Firm*—Carl W. Baker; Richard V. Lang

[57] ABSTRACT

An RF transparent antenna shield structure is disclosed particularly useful for missile nose cone radome and other severe environment applications. The structure comprises a solid metal wall member perforated to form a triangular grid array of windows each of which has fitted within it a dielectric plug member the end faces of which are flush with the opposite surfaces of the metal wall member. The thickness of the wall member and the dielectric constant of these plug members are chosen such as provide a resonant radome thickness. The waveguide-space junction susceptances are tuned out by capacitive iris members concentrically disposed on the plug member end faces, to yield acceptable uniformity of insertion phase and attenuation even at relatively extreme incidence angles.

10 Claims, 8 Drawing Figures

RF-TRANSPARENT SHIELD STRUCTURES

The U.S. Government has rights in this invention pursuant to Contract No. DASG-60-79-C-0089 awarded by the Department of the Army.

BACKGROUND OF THE INVENTION

This invention relates generally to radomes and like RF-transparent shield structures, and more particularly to radomes adapted to function under severe environmental conditions involving high thermal and mechanical stress levels.

The RF-transparent shield structures of the present invention have utility in a variety of applications such as in radomes for high speed aircraft and radomes for ground radars which must be "hardened" against nuclear radiation and overpressure. They offer particular advantage for use as missile nose cone radomes, in which the radome serves both as a radar window and to define the aerodynamic profile for the missile forward end. In this application the radome must provide high transmission efficiency and low insertion phase distortion over a wide range of radiation incidence angles, and must do so irrespective of polarization of the radiation. Further it must accomplish this in the presence of a severe thermal heating environment and high aerodynamic and "g" loading forces, so the radome must be very strong mechanically, be capable of withstanding thermal shock, and be able to maintain its high transmission efficiency and low phase distortion under high temperature conditions.

Among prior art radome proposals for the missile nose cone application are all-dielectric radome structures. The principal difficulty with such solid dielectric radomes is the present unavailability of ceramics or other dielectric materials which combine the necessary mechanical and electrical characteristics. For example, materials such as beryllium oxide and silicon nitride provide relatively good mechanical strength if of sufficient thickness, and have good erosion resistance. However, these materials are lacking in thermal shock resistance in the most severe environments, and the thick walls required for strength are too thick for good electrical characteristics at millimeter wavelengths. Also,- presently available beryllium oxides exhibit excessive change in dielectric constant with temperature, and silicon nitrides are excessively lossy particularly at high temperatures. Materials such as fused quartz and boron nitride, which offer more compatible electrical characteristics, generally do not meet mechanical and thermal stress requirements when fabricated into bodies of the size required for all-dielectric radome applications.

Other candidate missile radome designs include that disclosed in U.S. Pat. No. 3,975,738 to Pelton et al, employing a thin sheet of metal apertured by a plurality of "tripole" configured slots disposed in a triangular grid structure. Such thin metal structures are not themselves capable of withstanding the mechanical and thermal stresses encountered in the missile nose cone application, and when interleaved or otherwise integrated into a multilayer ceramic nose cone structure they are subject to the problems noted above with respect to the all-dielectric radome design. Two other RF-shield structures are disclosed in U.S. Pat. Nos. 3,310,808 to Friis and 3,448,455 to Alfandari et al. Both these designs employ dielectric rods which project beyond the surfaces of the metal wall structures in which the rods are disposed, and as a consequence these designs are not suitable for the missile nose cone and similarly demanding applications.

The present invention has as its principal objective the provision of a radome design capable of surviving extreme environmental conditions as encountered in missile and similar applications, and capable of meeting electrical performance requirements notwithstanding those conditions. One such requirement commonly encountered is that the energy propagating through the radome be attenuated relatively little thereby, and that both this attenuation and the insertion phase introduced by the radome be as constant as possible for all radiation incidence angles as well as for two orthogonal polarizations of the incident radiation. To achieve these objectives the conditions which must be satisfied insofar as possible are that the equivalent electrical thickness of the radome remain essentially constant and be independent of polarization and incidence angle, and that the insertion phase be also independent of polarization and incidence angle. Additionally, for the environmentally severe applications under consideration, the radome structure must be adequate to withstand large mechanical forces, strong thermal shock and high temperatures. Although all these desiderata cannot be completely satisfied under all conditions, the radome of the present invention provides a useful and workable solution well adapted to many difficult application requirements.

SUMMARY OF THE INVENTION

In its presently preferred embodiment an RF-transparent antenna shield structure in accordance with the present invention comprises a metallic body defining a wall member which, for the missile nose cone application, would be shaped appropriately to satisfy the aerodynamic configuration requirements of the missile. This metal wall member is perforated by a grid of circular-section apertures the centers of which preferably are arranged in an equilateral triangular grid configuration with the aperture centers spaced apart substantially uniformly by less than half the wavelength of the RF energy to be passed. Each of the apertures is filled by a dielectric plug member which may be fabricated of a suitable high temperature dielectric material such as fused quartz or boron nitride. These plug members and the wall member in which they are mounted together define a plurality of circular-section waveguides the equivalent electrical length of which is equal to $N\lambda_g/2$, where $\lambda_g$ is the wavelength of the RF energy in the waveguide and N is an integer selected to provide predetermined mechanical strength for the structure. Thus the thickness of the metallic wall member is selected as a function of the dielectric constant of the plug members, their diameter, and the operating wavelength, since all these parameters enter into the determination of the equivalent electrical length of the waveguides formed thereby.

The variation in "transparency" and insertion phase of a structure as just described with variation of incidence angle of the radiation on that structure is due principally to variations in aperture susceptances attributable to energy storage in non-radiating high-order modes at the waveguide-space interfaces, i.e., at the outwardly facing ends of the dielectric plug members. These susceptances are in general a function of incidence angle. They can, however, be made relatively constant as a function of incidence angle and polarization, by selecting a close aperture grid spacing, typically 0.3 to 0.5λ (where λ is the free-space wavelength), and selecting a plug diameter and dielectric constant which support transmission of the $TE_{11}$ mode but not higher order modes. The aperture susceptances thus made minimally variable are tuned out at each of the outwardly facing ends of the dielectric plug members preferably by placing on each a coaxially disposed capacitive iris of electrically conductive material. The radome thickness is then chosen to provide a resonant operation at the desired frequency by making the radome of equivalent electrical length equal to $N\lambda g/2$ as previously explained.

As previously mentioned, the apertures forming the waveguides preferably are arranged in an equilateral triangular grid configuration, and for the missile nose cone application the planar apex angle of this triangular grid may desirably be correlated with the cone angle of the missile nose cone. By choosing a triangular grid such that the planar surface edges of the grid correspond to lines of symmetry of the triangular grid, the grid pattern will match at the joining line when formed into a conical nose cone configuration and the grid pattern will be uniform over the entire cone. With this conical nose cone design, the waveguide-space junction admittances vary somewhat with axial location along the cone axis, and they differ also between the inwardly and outwardly facing ends of the dielectric plug members due to varying curvature of the surface. The iris tuning may be adjusted to account for this by using several differently-sized disc members over the radome inner and outer surfaces.

Particularly in the missile nose cone application, it has been found desirable as a final step to apply a thin conformal coating of a material such as alumina or like material. This provides improved erosion resistance, radiant energy reflectivity, and enhanced security of positioning of the dielectric plug members in the radome.

BRIEF DESCRIPTION OF THE DRAWINGS

While the specification concludes with claims particularly pointing out and distinctly claiming the present invention, the foregoing and other features and advantages of the invention can be more readily ascertained from the following detailed description when read in conjunction with the accompanying drawings, in which:

DESCRIPTION OF THE PREFERRED EMBODIMENT

Figure 1:
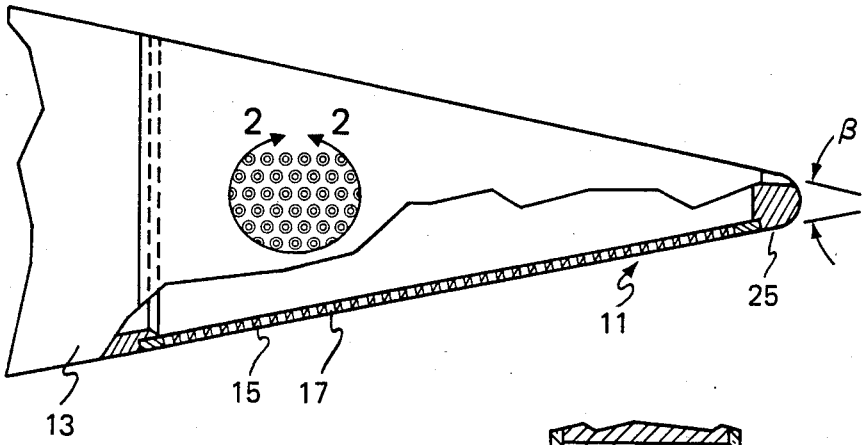
FIG. 1 illustrates a representative missile nose cone application for the radome of the present invention.

FIG. 1 illustrates a radome in accordance with the present invention, as utilized in a missile nose radar application. The radome, designated generally by reference numeral 11, is mounted to the forward end of the missile body 13 and forms an extension of its aerodynamic contour. A target seeking or homing radar (not shown) is positioned adjacent to the forward end of the missile with its antenna disposed at the aft end of the radome so as to enable transmission and reception through the radome wall. As will be obvious, the angle of incidence of the radiation on this wall varies quite widely with changes in radar scan angle or boresight direction, and for many directions of scan the incidence angle is sufficiently large to introduce problems of insertion phase distortion and reduced transmission efficiency.

Figure 3:
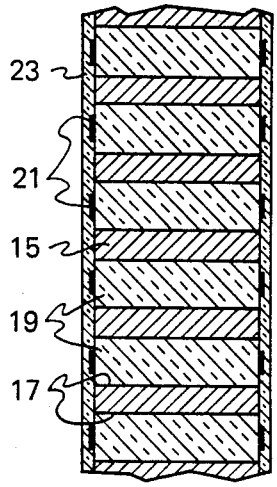
FIG. 3 is a cross-section taken along the lines 3—3 in FIG. 2.
Figure 2:
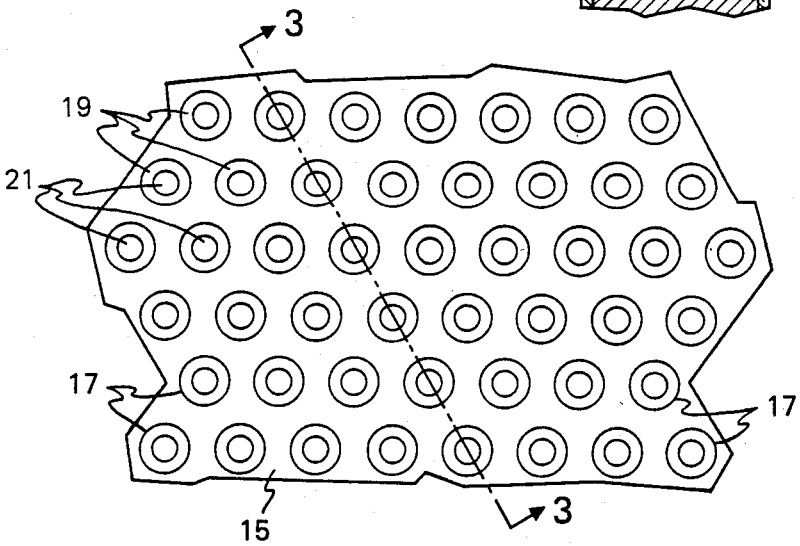
FIG. 2 is an enlargement of the area identified at 2—2 in FIG. 1, showing the waveguide apertures therein.

The radome of this invention comprises a metallic wall member 15 shaped as a hollow cone and windowed by a plurality of circular section apertures 17 arrayed as shown in FIG. 2, from which it may be seen that the apertures are disposed in a triangular grid configuration and uniformly distributed over the entire surface of the radome. As best seen in FIG. 3, each of the apertures 17 is filled by a dielectric plug member 19 of length just equal to the thickness of the metallic wall member 15, so as to place its outwardly facing end surfaces flush with the adjoining surfaces of the wall member. Concentrically disposed on each end surface of each of these dielectric plug members 19 is a circular electrically-conductive disc 21 which functions as a capacitive iris to tune out the inductive susceptance of the waveguide-space junction. Both sides of the radome thus comprised preferably are coated with a thin protective coating as at 23, which provides improved erosion resistance, assists in retaining the plugs in position, and provides a highly reflective surface effective to reduce radiant energy absorption in a nuclear environment. The assembly is completed by a nose tip member 25 of the same conical shape as the radome.

The metallic wall member 15 may be formed of any metal having strength and other mechanical characteristics suitable for the environmental and other requirements of the application. For applications not involving extreme high temperature exposures, aluminum is often to be preferred because of its relatively light weight and low cost. Brass or copper may also be suitable, and for high velocity missile and other applications requiring greater structural strength and higher temperature capability, a beryllium copper alloy or one of the "super alloy" high temperature steel alloys are the presently preferred materials.

The dielectric plug members may be fabricated of fused quartz, which is suitable for many applications particularly if erosion shielding for it is provided as by the protective coatings 23 previously mentioned. Other candidate materials are boron nitride, silicon nitride and beryllium oxide, though the latter two materials in presently available formulations typically are subject to certain shortcomings as noted above. The plug members 19 preferably are lightly press fitted into the apertures in the wall member 15.

Retention of the plugs may be accomplished or enhanced in a number of other or additional ways, i.e., by mechanical captivation as by peening the metal surrounding the plug after insertion, or by using ceramic adhesives.

The capacitive iris members 21 are of metal such as copper or molybdenum and may be applied to the ends of the dielectric plug members 19 using any convenient deposition method such as sputtering. These irises may be very thin since they carry no significant current, and their thickness is shown exaggerated in FIG. 3 for purposes of clarity.

The thickness of the protective conformal coating 23 is likewise exaggerated as illustrated in FIG. 3; this coating typically may be of the order of 0.002 inches to 0.010 inches in thickness. A preferred coating material is aluminum oxide ($Al_2O_3$), plasma-sprayed onto the radome surfaces preferably through a multi-pass operation providing a uniform coating over the entire surface of the radome.

The metallic wall member apertures and the di-electric plug members filling these apertures together define circular section waveguides for $TE_{11}$ mode propagation of RF energy therethrough. The waveguides thus constituted are characterized by aperture admittances having a real part (conductance) resulting from the radiated energy, and an imaginary part (susceptance) caused by energy storage in non-radiating high order modes at the waveguide-space junction. Between the two apertures, the transmission lines represented by the waveguides have constant phase length at a given frequency, but the admittances themselves vary as a function of incidence angle and, unless controlled, would introduce an undesirable variation in radome performance with incidence angle.

The insertion phase of the radome passages when the wall thickness is adjusted to provide an electrical length of $N\lambda_g/2$ can be expressed as follows:

$$\phi = -\tan^{-1}\frac{b}{g} - N\pi \qquad \text{Equation 1}$$

where
$\phi$=insertion phase
b=junction susceptance
g=radiation conductance

As mentioned earlier, both the conductance and susceptance vary with incidence angle and polarization. However, Equation 1 above shows that if the susceptance, b, can be made zero, the insertion phase is constant. Under the condition of b=0, the resonant thickness of the radome wall is constant for all incident angles and for all polarizations as well.

In order to make b=0, this susceptance must be tuned out by some means, preferably an iris at the waveguide-space interface. For this to be effective, b must be constant or nearly constant over the required range of incidence angles and polarizations.

The magnitude and range of variation of the junction susceptance b can be minimized by closely spacing the apertures of the triangular grid. To this end, the apertures are arrayed with center-to-center spacing of less than half the free space wavelength $\lambda$ of the radiation, and preferably with spacing within the range of 0.35 to 0.45 $\lambda$. Within this range, the center-to-center spacing is made as close as possible, consistent with the requirements for adequate aperture diameter to support $TE_{11}$ mode operation and to retain adequate mechanical strength With aperture susceptance variability thus minimized, the susceptances may then be tuned out by the capacitive irises 21 concentrically disposed on the outwardly facing end surfaces of each of the di-electric plug members The diameters of these irises are determined empirically, by varying the iris diameter to achieve minimum residual susceptance. Typically the iris diameter will average about 0.6 to 0.8 times the diameter of the dielectric plug member itself, and may vary within this range along the length of the radome and also as between its inward and outward facing surfaces, so as to match as precisely as possible the junction admittances at each location on the cone.

As previously noted, the apertures 17 are of diameter at least sufficiently large to support propagation of the desired $TE_{11}$ mode within them, and preferably are made as large as possible, consistent with the previously stated center-to-center spacing requirement and the requirement that adequate metal be left between apertures to enable the wall member to meet mechanical strength specifications. The thickness of the metallic wall member, which is also the length of the dielectric plug members, is chosen so as to provide resonant operation of the radome. This requires that the waveguide elements have an equivalent electrical length $L_e$ in accordance with the relation:

$$L_e = N\lambda_g/2 \qquad \text{Equation 2}$$

where $\lambda_g$ is the guide wavelength and N is an integer multiple selected to meet mechanical strength requirements of the radome structure. Generally N should be kept as low as possible consistent with strength requirements, as minimum thickness of the radome wall enhances the resonance bandwidth.

The guide wavelength $\lambda_g$ is given by the relation:

$$\lambda_g = \frac{\lambda}{\sqrt{\epsilon_r - (\lambda/\lambda_c)^2}} \qquad \text{Equation 3}$$

where $\epsilon_r$ is the relative dielectric constant of the material of the dielectric plug members, $\lambda$ is the free-space wavelength, and $\lambda_c$ is the guide cutoff wavelength. For quartz dielectric, $\epsilon_r$ is equal to 3.84, and for the $TE_{11}$ mode in circular waveguide, $\lambda_c$ is equal to 3.41 times the guide radius r.

Figure 6:
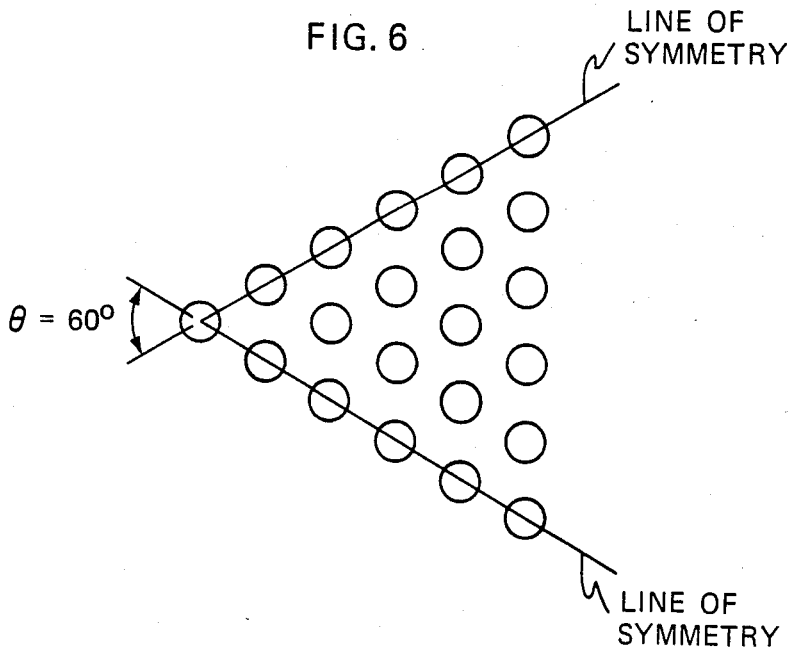
FIG. 6 illustrates the geometric relationship between triangular grid configuration and cone angle in the radome of FIGS. 1–3.

As previously mentioned, the apertures forming these waveguide elements preferably are disposed in a triangular grid configuration. For the missile nose cone application, the planar apex angle, $\theta$, of the triangular grid array shown in FIG. 6 is related to the conical half-angle, $\beta/2$, where $\beta$ is the included angle of the missile nose cone as indicated in FIG., 1 by the relation:

$$\sin\frac{\beta}{2} = \frac{\theta}{2\pi} \qquad \text{Equation 4}$$

If a triangular grid is chosen such that the planar surface edges correspond to lines of symmetry of the triangular grid, then when the grid pattern is bent to conical configuration the pattern will match at the joining line and will be uniform over the whole cone. For example, if an equilateral triangular grid is used, the lines of symmetry are separated by multiples of 60° as shown in FIG. 6. With $\theta$ equal to 60°, Equation 3 shows $\beta$ to be 19.2 degrees, which is a practical cone angle for a high velocity missile.

Following the design principles just set forth, a typical radome structure intended for operation at 30 GHz, and utilizing fused quartz as the material for the dielectric plug members, might be dimensioned with a center-to-center aperture spacing of 4.0 mm and an aperture diameter of 3.2 mm. Equation 3 then would yield a value of 14.4 mm for $\lambda_g$, and Equation 2 a wall thickness in this example of 7.2 mm or some integral multiple of that value.

Figure 4:
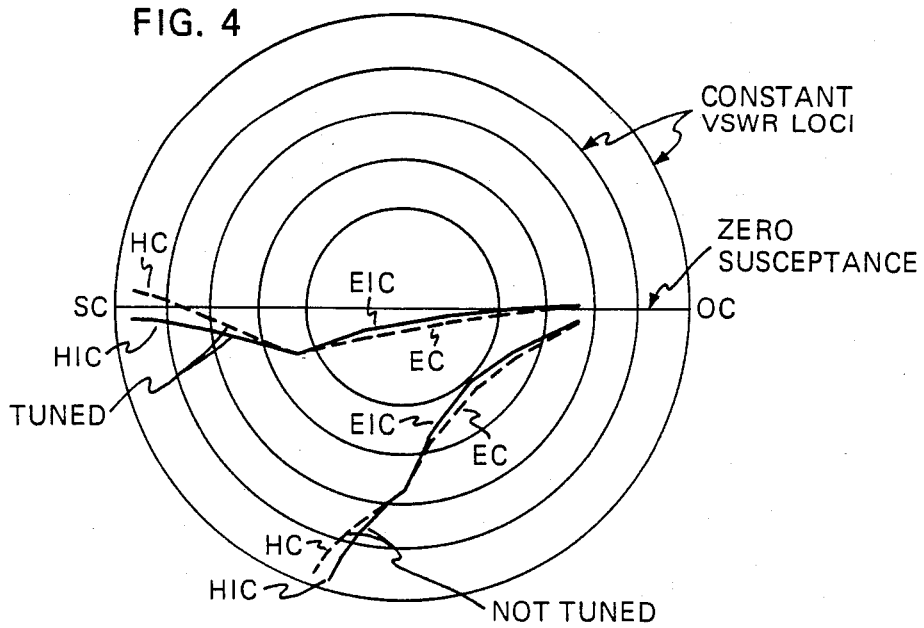
FIG. 4 illustrates the effect of tuning the aperture susceptances in the radome of FIGS. 1–3.

FIG. 4 is a Smith chart showing tuned and untuned admittances at one end of the waveguide windows in a radome as shown in FIG. 1. Plots are shown for the H-plane cardinal incidence (H C), H-plane intercardinal (H IC), E plane cardinal (E C) and E plane intercardinal (E IC) cases. The terms "cardinal" and "intercardinal" here refer to the orientation of the plane of incidence with respect to the triangular grid orientation on the radome surface at the point of incidence. All intermediate plane cases fall between the cardinal and intercardinal cases.

The purpose of presenting both the cardinal and intercardinal cases is to show that there is only a small difference in the admittance due to grid orientation. It is therefore possible to tune the susceptance with a single capacitance with only a slight degree of approximation.

The tuned case illustrated in FIG. 4 illustrates the net admittance after tuning with a capacitive susceptance of appropriate magnitude. The ideal locus of this net admittance would be the horizontal diameter of the Smith chart, the locus of zero susceptance. As shown, the net susceptance is not reduced to exactly zero, but its magnitude is minimized resulting in a condition where the radome wall maximum transmission response is sufficiently close to frequency coincidence for various incidence angles and polarizations that the transmitted amplitude and insertion phase of the radome wall remain sufficiently constant to meet the practical requirements of antenna beam shape control and boresight stability.

Figure 5:
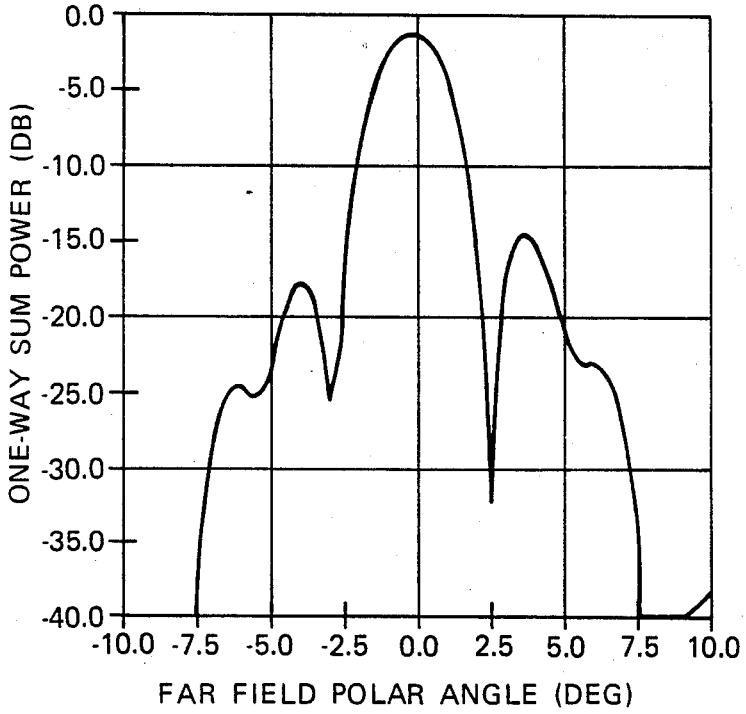
FIG. 5 illustrates a typical computed sum power pattern for the radome of FIGS. 1–3.

FIG. 5 illustrates a computed sum power pattern at 0° scan angle for a representative radome of the configuration illustrated in FIG. 1. The slight asymmetry in the illustrated sum pattern is due to radome grid effects resulting from the differences in cardinal and intercardinal plane transmission efficiency, which make the radome appear slightly non-uniform in its characteristics. It is to be expected that the RF opacity of the missile nose tip 25 also may introduce slight asymmetry at scan angles just off the missile axis, resulting in some small shift of the radar bore-sight at such angles. However, since this boresight error is of relatively modest magnitude and is related to fixed geometry of the radome, it can be almost completely calibrated out as a function of scan angle leaving a residual error expected to be less than one milliradian.

Figure 7:
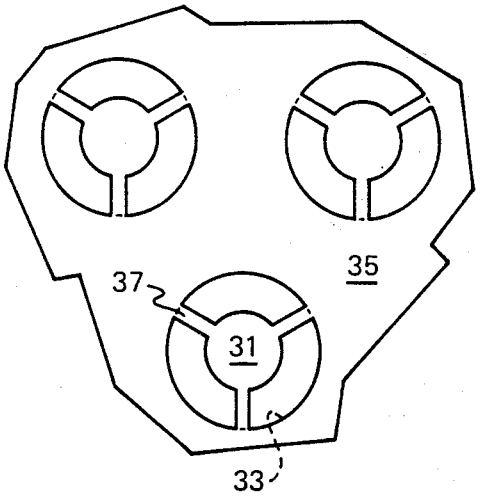
FIGS. 7 and 8 illustrate alternative capacitive iris structures usable in the radome of FIGS. 1–3.
Figure 8:
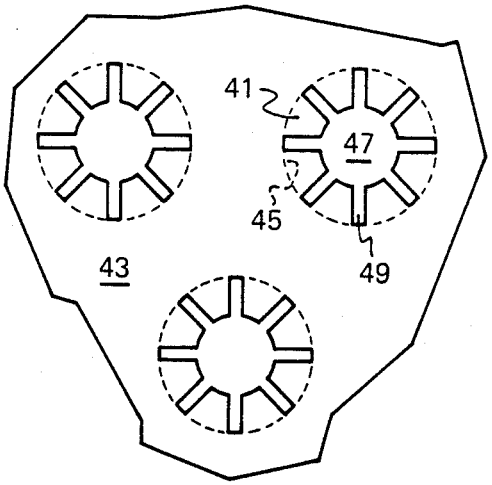

The capacitive iris consisting of a thin centered metal disc has been discussed hereinabove as one preferred tuning means, but other implementations are possible. Two such alternatives are shown in FIGS. 7 and 8 for use where the metallic wall member is provided with a separate ground plane or planes, as by a metallic laminate which is applied to one or both sides of the wall member or which comprises the external layer of a laminated metal wall structure. The iris as shown in FIG. 7 consists of a circular metal disc 31 which is centered over the waveguide passage 33 and connected to the metal ground plane 35 surrounding the waveguide passage by a number of integrally formed strips 37 symmetrically located around the periphery of the disc. Three or more such strips are required to provide sufficient uniformity to two orthogonal polarizations. This iris provides an acceptable capacitive susceptance, though its susceptance has a somewhat greater variation with frequency than that of the isolated circular disc described above. The strips connecting the disc to the ground plane provide an advantage in severe environments in enhancing the security of disc attachment.

In FIG. 8 the iris is shown to comprise a generally annular projection 41 of the metal ground plane 43 over each waveguide passage 45, thus defining a circular hole 47 centered over the waveguide. Radial slots 49 are formed in the annulus 41, leaving a number of symmetrically positioned metal protrusions which extend over the waveguide opening from the surrounding ground plane. Eight or more slots are preferred, since the capacitance increases with the number of slots at least up to sixteen slots. This iris provides a capacitive susceptance having a variation with frequency which is comparable to that of the centered isolated disc.

Tuning arrangements using irises disposed internally of the waveguides are also possible but have been found to be more frequency sensitive than the surface mounted irises and therefore have a deleterious effect upon the bandwidth of the radome transmission response. Yet another arrangement is useful in the case of radome structures provided with a conformal coating of di-electric material, such as described above with reference to FIG. 1, where the aluminum oxide or other coating material used has a substantially higher dielectric constant than that of the material comprising the waveguide plus member itself. The dielectric constant of fused quartz is about 3.8, for example, while that of $Al_2O_3$ is about 10. With this ratio of dielectric constants the areas of the conformal coating which overlie the waveguide passages constitute capacitive iris means in themselves, with their reactance being of magnitude dependent on the thickness of the coating in these areas. In the case of the particular materials under discussion, for example, it is possible simply by increasing the thickness of the aluminum oxide coating to perhaps 0.007 inches to provide capacitive reactances of value such as to tune out the junction susceptances, though only over a somewhat narrower frequency band than in the embodiments previously described.

Many other modifications will occur to those skilled in the art and it therefore should be understood that the appended claims are intended to cover all such modifications as fall within the true spirit and scope of the invention.

What is claimed is:

1. A radome transparent to electromagnetic radiation of predetermined wavelength comprising a shaped metallic body perforated by a grid of circular-section apertures disposed on centers spaced substantially uniformly from each other by less than $\lambda/2$ where $\lambda$ is equal to said predetermined wavelength, each such aperture being filled by a plug member of dielectric material with the outwardly facing ends of each such plug member lying flush with the adjoining surface of said metallic body, and capacitive iris means disposed on each of the outwardly facing ends of each of said plug members for tuning out the aperture susceptances and enabling operation of the radome with substantially constant resonant thickness and insertion phase, said metallic body being of thickness such that the equivalent electrical length of the waveguides defined by the dielectric-filled apertures therein is approximately equal to $N\lambda_g/2$ where $\lambda_g$ is equal to the guide wavelength and N is an integer selected to provide determined mechanical strength for the radome.

2. A radome as defined in claim 1 wherein said grid is an equilateral triangular grid having a planar apex angle $\theta$ of 60 degrees.

3. A radome as defined in claim 2 wherein said metallic body is shaped as a hollow cone with a cone angle $\beta$ given by the relation $\sin \beta/2 = \theta/2\pi$.

4. A radome is defined in claim 3 wherein said capacitive iris means comprise a plurality of electrically conductive discs each centered on one of said plug member ends.

5. A radome as defined in claim 4 wherein said electrically conductive discs are of sizes graduated as a function of axial location along the cone.

6. A radome as defined in claim 1 wherein said metallic body includes a ground plane laminate and said capacitive iris means are formed integrally therewith, said iris means comprising a plurality of radially slotted annuli each concentrically overlying one of said apertures.

7. A radome as defined in claim 1 wherein said metallic body includes a ground plane laminate and said capacitive iris means are formed integrally therewith, said iris means comprising a plurality of circular discs of diameter smaller than said apertures with each disc concentrically overlying an aperture and connected by at least three radially extending tabs to the remainder of the ground plane.

8. A radome as defined in claim 1 wherein at least one surface of said metallic body is provided with a conformal coating providing improved erosion resistance, radiant energy reflectivity, and security of positioning of said dielectric plug members.

9. A radome as defined in claim 1 wherein said dielectric plug members are fabricated from a material selected from the group consisting of fused quartz, boron nitride and beryllium oxide.

10. An RF energy transmissive structure comprising a metallic wall member apertured by a uniform triangular grid of circular section windows of predetermined diameter and center-to-center spacing of less than $\lambda/2$ where $\lambda$ is the wavelength of the RF energy to be transmitted by the structure, a plurality of dielectric plug members each of length equal to the thickness of said metallic wall member and each disposed in and filling one of said windows to form therewith an RF waveguide element, the dimensions of said plug and wall members and the dielectric constant of said plug members being such that the equivalent electrical length of said waveguide elements is equal to $N\lambda_g/2$, where $\lambda_g$ is the guide wavelength and N is an integer selected to provide predetermined mechanical strength for the structure, and capacitive iris means disposed on each outwardly facing end surface of each of said dielectric plug members for tuning out the conductive susceptances of the waveguide-space junctions formed thereby.

* * * * *